US012102138B1

(12) United States Patent
Griffiths et al.

(10) Patent No.: US 12,102,138 B1
(45) Date of Patent: Oct. 1, 2024

(54) CUSTOMIZABLE SHAPEWEAR

(71) Applicant: Knix Wear Inc., Toronto (CA)

(72) Inventors: Joanna Griffiths, Toronto (CA); Julie Power, Toronto (CA); Linda Kritikos, Toronto (CA)

(73) Assignee: Knix Wear Inc., Toronto (CA)

( * ) Notice: Subject to any disclaimer, the term of this patent is extended or adjusted under 35 U.S.C. 154(b) by 0 days.

(21) Appl. No.: 18/491,629

(22) Filed: Oct. 20, 2023

(51) Int. Cl.
*A41B 9/00* (2006.01)

(52) U.S. Cl.
CPC ..... *A41B 9/00* (2013.01); *A41B 2400/38* (2013.01)

(58) Field of Classification Search
CPC ..... A41B 11/126; A41B 9/00; A41B 2400/38
See application file for complete search history.

(56) References Cited

U.S. PATENT DOCUMENTS 2,957,512 A * 10/1960 Wade ..... B32B 27/00 156/163
3,112,751 A * 12/1963 Grishman ..... A41C 1/04 450/97
3,122,906 A * 3/1964 Crawford ..... A41B 11/12 66/172 E
3,133,543 A * 5/1964 Bradd ..... A41C 1/02 450/156
3,338,776 A * 8/1967 Blair ..... A41C 1/02 2/407
3,729,956 A * 5/1973 Nebel ..... D04B 1/26 66/172 E
3,793,644 A * 2/1974 Kellner ..... A41D 15/002 2/48
4,438,533 A * 3/1984 Hefele ..... D04H 11/00 2/232
6,446,268 B1 * 9/2002 Lazarian ..... A41F 9/00 427/256
9,179,713 B2 * 11/2015 Hays ..... A41C 5/00
9,433,544 B1 * 9/2016 Ross ..... A41D 15/04
9,687,031 B2 * 6/2017 Turner ..... A41D 13/0015
D811,697 S * 3/2018 Ross ..... D2/840
9,930,916 B2 * 4/2018 Hays ..... A41C 5/00
10,117,470 B2 * 11/2018 Reese ..... A41D 13/1209
10,165,803 B2 * 1/2019 Hoeven ..... A41B 17/00
10,194,701 B1 * 2/2019 Tufts ..... A61M 27/00
10,231,492 B1 * 3/2019 Bastug ..... A41C 3/10
10,428,447 B2 * 10/2019 Tuerk ..... A41B 11/126

(Continued)

FOREIGN PATENT DOCUMENTS

AU 2017230807 A1 * 9/2018 ..... A41B 1/12
WO WO-2017156376 A1 * 9/2017 ..... A41B 1/12

OTHER PUBLICATIONS

Wolford Flocked Shaping Shorts: https://www.wolfordshop.com/outlet/flock-shaping-shorts/53100.7005.html; downloaded Oct. 20, 2023.

*Primary Examiner* — Richale L Quinn
(74) *Attorney, Agent, or Firm* — Kolitch Romano Dascenzo Gates LLC

(57) ABSTRACT

Customizable shapewear to be worn by a wearer comprises a body constructed of a fabric having a first texture. The body has an interior side that faces the wearer, and an exterior side that faces away from the wearer. The customizable shapewear further comprises a plurality of distinct applications on the interior side of the body and/or on the exterior side and having a second texture that differs from the first texture.

25 Claims, 8 Drawing Sheets

(56) References Cited

U.S. PATENT DOCUMENTS 10,455,866 B2 * 10/2019 Hays ..... A41C 1/08
10,694,788 B2 * 6/2020 Profeta ..... A41B 17/00
10,709,176 B2 * 7/2020 Maier ..... A41D 27/14
10,806,190 B1 * 10/2020 Kardashian West ... A41C 1/003
11,357,271 B2 * 6/2022 Mason ..... A61F 13/148
11,464,266 B2 * 10/2022 Kositchiranant ..... A41F 9/02
11,793,243 B2 * 10/2023 Xu ..... A41C 5/00
2001/0042389 A1 * 11/2001 Fujiwara ..... D04B 21/207
66/196
2007/0028343 A1 * 2/2007 Makowka ..... A41D 13/00
2/48
2008/0092273 A1 * 4/2008 Marshall ..... A41D 1/08
2/227
2009/0047481 A1 * 2/2009 Welsch ..... A41H 43/00
428/179
2011/0083246 A1 * 4/2011 Vitarana ..... A41D 31/065
2/243.1
2012/0309850 A1 * 12/2012 Rinke ..... A61F 15/006
2/400
2013/0152268 A1 * 6/2013 Langdon ..... A41B 13/00
2/80
2015/0038052 A1 * 2/2015 Hays ..... A41C 1/12
450/156
2015/0342265 A1 * 12/2015 Hays ..... A41C 1/08
427/206
2017/0099884 A1 * 4/2017 Martinet ..... A41C 3/10
2018/0153224 A1 * 6/2018 Tuerk ..... A41B 11/126
2018/0271177 A1 * 9/2018 McGuire ..... A41B 11/128
2019/0021404 A1 * 1/2019 Hays ..... A41C 5/00
2019/0159527 A1 * 5/2019 Guarnaschelli ..... A41C 3/0014
2019/0231006 A1 * 8/2019 Allen ..... A41D 15/005
2019/0364999 A1 * 12/2019 Baschak ..... A41F 17/00
2020/0100550 A1 * 4/2020 Moeller ..... A41F 17/00
2020/0383387 A1 * 12/2020 Lee ..... A41B 11/121
2021/0084993 A1 * 3/2021 Hays ..... A41C 1/08
2021/0120886 A1 * 4/2021 Webb ..... A41D 1/04
2021/0219625 A1 * 7/2021 Zhou ..... A41D 19/0041
2022/0132988 A1 * 5/2022 Nishi ..... A63B 60/08
36/59 R
2022/0248777 A1 * 8/2022 Gilbert ..... A41D 1/088
2023/0085435 A1 * 3/2023 Olson ..... A41B 1/08
2/115
2023/0206419 A1 * 6/2023 Zussman ..... G06Q 30/0643
345/419

* cited by examiner

CUSTOMIZABLE SHAPEWEAR

FIELD

The present disclosure relates to shapewear.

BACKGROUND

Shapewear are form-fitting and/or tight undergarments worn to maintain or create a desired shape or smooth surface to a wearer's body. Typically, shapewear designed to be worn at least on the wearer's lower body comprises at least a pelvic region that is configured to be worn around the pelvic region of the wearer. Some shapewear may be described as lower body garments, and may be described as underwear, panties, shorts, or leggings. When including legs that extend from the pelvic region, the legs of some such lower body garments extend only partially down the wearer's thighs and may be described as briefs or boy shorts. In other examples, the legs may extend to just above a wearer's knees and may be described as shorts. In yet other examples, the leg regions may extend to below a wearer's knees and even to the wearer's ankles and be described as knickers, pants, or leggings.

Some shapewear may be described as bodysuits, such as including a torso region extending upward from the pelvic region and including shoulder straps or sleeves. Such bodysuits may or may not also include legs, as discussed above with respect to lower body garments. Some shapewear may be described as sleeveless or as having a tank top. When including sleeves, the sleeves may extend to a wearer's upper arms, elbow, forearm, or wrist. Typically, the wearer selects an appropriate configuration of shapewear depending on the regions of the body sought to be shaped and on the configuration of outer garments to be worn. For example, if a knee-length skirt or dress is to be worn, shapewear that does not extend below the knees may be selected. If a short-sleeve top is to be worn, shapewear with shoulder straps, as opposed to sleeves, may be selected.

SUMMARY

Customizable shapewear comprises a body that is constructed of a fabric. The body has an interior side that faces a wearer when the customizable shapewear is worn by the wearer, and an exterior side that faces away from the wearer when the customizable shapewear is worn by the wearer. The customizable shapewear further comprises a plurality of distinct applications on the interior side of the body and/or on the exterior side.

DESCRIPTION

Outer garments are not always laterally symmetrical, such as dresses or skirts with slits or outfits with only one sleeve or different length sleeves. Some outer garments have holes or openings in them for aesthetics, such as backless dresses or blouses. In such situations, typical shapewear may not be suitable for wearing, as the shapewear may be undesirably visible, thereby detracting from the aesthetics of the outer garment. Customizable shapewear 10 according to the present disclosure, however, is customizable by the wearer for use with various configurations of outer garments.

Figure 1:
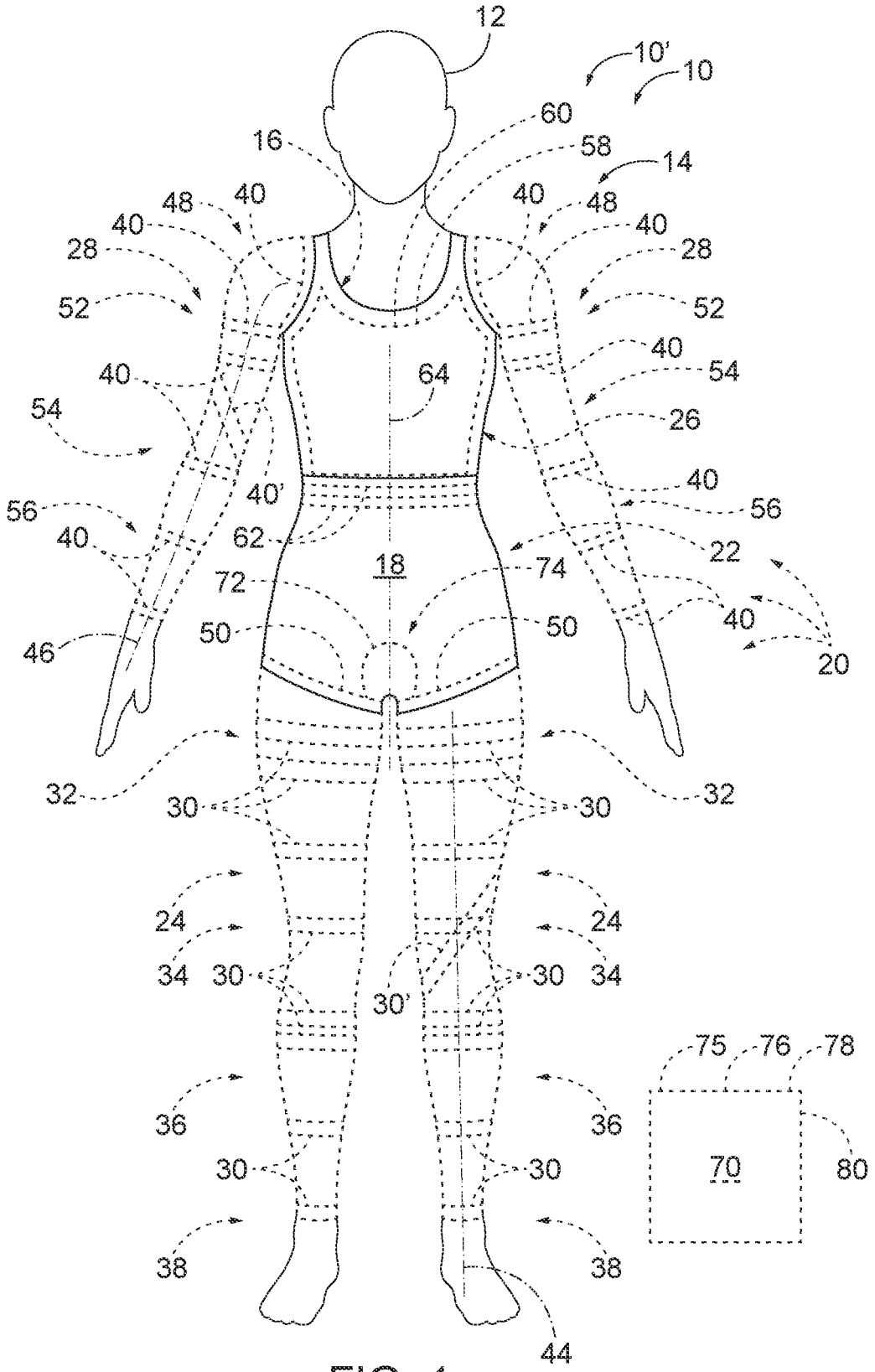
FIG. 1 schematically represents customizable shapewear according to the present disclosure.

FIG. 1 schematically illustrates customizable shapewear 10. Generally, in FIG. 1, elements that are likely to be included in a given example are illustrated in solid lines, while elements that are optional to a given example or correspond to a specific example are illustrated in broken lines. Customizable shapewear 10 to be worn by a wearer 12 comprise at least a body 14 that is constructed of a fabric. The body 14 may be described as having an interior side 16 that faces the wearer 12 when the customizable shapewear 10 is worn by the wearer 12, and an exterior side 18 that faces away from the wearer 12 when the customizable shapewear 10 is worn by the wearer 12. Customizable shapewear 10 further comprises a plurality of distinct applications 20 on the interior side 16 of the body 14 and/or on the exterior side 18. The plurality of distinct applications 20 additionally or alternatively may be described as distinct regions, treatments, or finishes that are applied to the body 14.

In some examples of customizable shapewear 10, the distinct applications 20 are on at least the interior side 16 of the body 14 and optionally also on the exterior side 18 of the body 14. In some examples, the distinct applications 20 are only on the interior side 16 of the body 14. In other examples, the distinct applications 20 are on at least the exterior side 18 of the body 14, and optionally also on the interior side 16 of the body 14. At least a subset of the distinct applications 20 is provided to facilitate customization of the customizable shapewear 10, as discussed herein. In addition, a subset of the distinct applications 20 optionally may be provided to facilitate shaping of a wearer's body, such as based on the location and shape of the distinct applications 20. For example, one or more distinct applications 20 may be configured to lift and/or shape a wearer's buttocks and/or a wearer's breasts. Additionally or alternatively, a subset of distinct applications 20 may be provided for aesthetics on the exterior side 18 of the body 14. A distinct application 20 may fall into one or more of these optional subsets of distinct applications 20.

As noted, at least a subset of the distinct applications 20 is provided to facilitate customization of the customizable shapewear 10. For example, when the body 14 is selectively cut along a selected distinct application 20 of the plurality of distinct applications 20 to remove a portion of the customizable shapewear 10 and to thereby create a customized shapewear 10', in some examples, the selected distinct application 20 restricts rolling of the body 14 that is adjacent to or that is at the selected distinct application 20 relative to the wearer 12 when the customized shapewear 10 is worn by the wearer 12. Accordingly, in such examples, when the selected distinct application 20 is cut, or the body 14 is cut adjacent to the selected distinct application 20, a portion of the body 14 (e.g., a portion of a leg or sleeve) will be removed and the selected distinct application 20 will maintain the body 14 in a desired configuration and/or position on the wearer's body when the customized shapewear 10' is worn. The selected distinct application 20 may be cut along while the customizable shapewear 10 is worn by a wearer 12 or while the customizable shapewear 10 is not being worn.

In some examples, the fabric from which the body 14 is constructed has a first texture, and the plurality of distinct applications 20 have a second texture that differs from the first texture.

Additionally or alternatively, in some examples, when the body 14 is selectively cut along a selected distinct application 20, the selected distinct application 20 is configured to restrict sliding of the body 14 adjacent to or at the selected distinct application 20 relative to the wearer 12 when the customized shapewear 10' is worn by the wearer 12. In particular, the distinct applications 20 may be constructed of a material and/or have a texture that provides sufficient friction or grip relative to a wearer's skin. In some such examples, the coefficient of friction of the distinct applications 20 is greater than the coefficient of friction of the fabric from which the body 14 is constructed. Stated differently, in some examples, the texture of the distinct applications 20 is configured to provide a no-slip surface against the wearer 12 when the customized shapewear 10' is worn by the wearer 12.

Additionally or alternatively, in some examples, the selected distinct application 20 is configured to restrict fraying of the body 14 adjacent to the selected distinct application 20 when the body 14 is selectively cut along the selected distinct application 20.

Additionally or alternatively, in some examples, the fabric of the body 14 may be described as having a first elastic modulus, and the plurality of distinct applications 20 may be described as having a second elastic modulus or second elastic moduli that is/are greater than the first elastic modulus. Additionally or alternatively, a combination of the fabric and the plurality of distinct applications 20 may be described as having a second elastic modulus that is greater than the first elastic modulus. In other words, the regions of the customizable shapewear 10 where the distinct applications 20 are positioned may be less stretchy than regions of the body 14 where no distinct applications 20 are present. As a result, the distinct applications 20 may be used to shape, lift, and/or smooth portions of the wearer's body relative to regions of the body 14 where the distinct applications 20 are not present. In addition and as a result, a distinct application 20 may serve to restrict the customizable shapewear 10 from sliding relative to the wearer's skin, such as along the wearer's arms or legs, depending on the configuration of the customizable shapewear 10 and/or on the customization of the customizable shapewear 10 by a user.

As illustrative non-exclusive examples, the body 14 may be constructed of one or more of synthetic fibers, such as, spandex (elastane), nylon, and/or polyester, and/or natural fibers, such as cotton, bamboo, and/or modal, and the plurality of distinct applications 20 also may be constructed of one or more of acrylic, silicone, nylon, polyester, spandex, cotton, bamboo, modal, bonding fabric, and/or seamless material produced on a Santoni machine (double knit electronic circular knitting machine). In some examples, the plurality of distinct applications 20 are coupled to the body 14 via an adhesive and/or via stitching. In some examples, the distinct applications 20 with the body 14 form a double-bonded region with two layers of fabric. In some examples, the plurality of distinct applications 20 are adhered to the body 14, such as via a flocking process, and may be described as comprising flocking that is adhered to the body 14. That is, in some examples, the plurality of distinct applications 20 comprise fine particles or fine fibers that are adhered to the interior side 16 and/or to the exterior side 18 of the body 14. A fine particle or fine fiber is a particle or fiber whose length is not significantly longer than its width or diameter, in contrast to elongated fibers used in a weaving or knitting construction of garments. Flocking typically is performed by electrically negatively charging the flocking material, applying an adhesive to the substrate (e.g., the body 14), and electrically grounding the substrate, such that the flocking material is electrically attracted to the substrate.

With continued reference to FIG. 1, customizable shapewear 10, prior to being customized, may take a variety of different configurations such as briefs, boy shorts, shorts, knickers, pants, leggings, tops, and bodysuits. In particular, the body 14 of customizable shapewear 10 typically comprises at least one of (i) a pelvic region 22 configured to be worn against the pelvic region of the wearer 12 and/or (ii) a torso region 26 (extending superior from the pelvic region 22, when present) configured to be worn against the torso (or trunk) of the wearer 12. The body 14 also may comprise one or more of (iii) leg regions 24 extending inferior from the pelvic region 22 and configured to be worn against the legs of the wearer 12, and (iv) arm regions 28 extending from the torso region 26 and configured to be worn against the arms of the wearer 12.

As schematically illustrated in FIG. 1, in some examples of customizable shapewear 10, the body 14 comprises the pelvic region 22 and the plurality of distinct applications 20 comprises one or more waist bands 62 positioned superior to the pelvic region 22. Accordingly, a wearer 12 may customize such a customizable shapewear 10 by cutting along the one or more waist bands 62 to remove a portion of the body 14 above the selected waist band 62 to select a desired height of the customized shapewear 10' along the wearer's hips, waist, and/or mid-section. For example, a customizable shapewear 10 that comprises a torso region 26 may be customized to remove the torso region 26, such as if the wearer desires to shape the wearer's pelvic region and/or lower body region but not the wearer's upper body region.

In another example, a customizable shapewear 10 comprises the pelvic region 22 but does not comprise a torso region 26 or at least does not comprise a torso region 26 that extends upward all the way to a wearer's shoulders, but comprises a plurality of distinct applications 20 that comprise waist bands 62, such that the wearer 12 may cut along a selected waist band 62 to remove a portion of the body 14 above the selected waist band 62 to select a lower height for the customized shapewear 10', such as depending on the height of a lower-body outer garment to be worn by the wearer 12. In some examples, each of the one or more waist bands 62 substantially encircles the body 14 of the customizable shapewear 10. By "substantially encircles" it is meant that the distinct application 20 serves its intended purpose when the customizable shapewear 10 is operatively cut along the distinct application 20 (e.g., prevent rolling, fraying, etc.). However, it is within the scope of "substantially encircles" that the distinct application 20 may not fully encircle, such as at a seam between two panels of fabric defining the body 14. As an example, "substantially encircles" may include encircling at least 90% or at least 95% of the respective structure, such as the body 14.

Although not required, in some examples, each of the one or more waist bands 62 is substantially uniform in width. By "substantially uniform in width," it is meant that the respective structure's width does not deviate more than 10% along its length. Such a configuration facilitates the selection and cutting of a distinct application 20. Non-exclusive examples of suitable widths of waist bands 62 include widths in the range of 0.5-2 centimeters (cm); however, widths narrower and wider than this range also may be provided. When a plurality of waist bands 62 is provided, a plurality of adjacent waist bands 62 may be spaced at various intervals, including uniform and non-uniform intervals. For example, the intervals may be selected to define and/or correspond to typical waist heights of lower body garments, such as high-rise, low-rise, hip-hugger, and the like.

As schematically represented in FIG. 1, the body 14 of customizable shapewear 10 may be described as having or defining a longitudinal body axis 64, such that is generally vertical and in the center of the body 14 when the customizable shapewear 10 is worn by a wearer 12. In some examples of customizable shapewear 10, each of the one or more waist bands 62 is substantially perpendicular to the longitudinal body axis 64. By "substantially perpendicular to the longitudinal body axis 64," it is meant that a respective waist band 62 is within 15° of perpendicular to the longitudinal body axis 64. Accordingly, such waist bands 62, when cut, result in an upper edge that is at an appropriate orientation to the remainder of the customized shapewear 10' to be worn as a lower body garment.

With continued reference to FIG. 1, in some examples in which the body 14 comprises the pelvic region 22 and leg regions 24, the plurality of distinct applications 20 comprises one or more hip bands 50 at interfaces between the leg regions 24 and the pelvic region 22. Accordingly, in examples of customizable shapewear 10 whose body 14 comprises both leg regions 24, the leg regions 24 may be removed by cutting along selected hip bands 50. As schematically illustrated in FIG. 1, the hip bands 50, when present, may substantially encircle the leg regions 24 and be skew relative to the longitudinal body axis 64. The hip bands 50, when present, may be substantially uniform in width, with non-exclusive examples of suitable widths in the range of 0.5-2 cm; however, widths narrower and wider than this range also may be provided.

In some examples in which the body 14 comprises the pelvic region 22 and leg regions 24, the plurality of distinct applications 20 comprises a plurality of leg bands 30 that are spaced-apart along the leg regions 24. When present, each of the plurality of leg bands 30 substantially encircles a respective one of the leg regions 24. In some examples, each of the plurality of leg bands 30 is substantially uniform in width. Accordingly, such leg bands 30 facilitate a user's cutting along a desired path. Non-exclusive examples of suitable widths of leg bands 30 include widths in the range of 0.5-2 cm; however, widths narrower and wider than this range also may be provided.

As schematically represented in FIG. 1, each leg region 24 may be described as having a longitudinal leg axis 44, and in some examples, although not required, one or more, and optionally each, of the plurality of leg bands 30 may be substantially perpendicular to a respective longitudinal leg axis 44. By "substantially perpendicular to a respective longitudinal leg axis 44," it is meant that a respective leg band 30 is within 15° of perpendicular to the respective longitudinal leg axis 44. Accordingly, such leg bands 30 permit a user to generally cut along a straight line that results in a cut line that is perpendicular to the wearer's legs when the customized shapewear 10' is worn.

In some examples, as indicated by the example leg band 30' in FIG. 1, one or more of the plurality of leg bands 30 may be skewed relative to a respective longitudinal leg axis 44. Accordingly, such examples may be used when an outerwear garment has an asymmetrical leg or a slit, for example.

With continued reference to FIG. 1, in some examples in which the body 14 comprises leg regions 24, the plurality of leg bands 30 comprises one or more leg bands 30 that are positioned within thigh regions 32 of the leg regions 24. Thigh regions 32 are regions of the leg regions 24 that correspond to and engage a wearer's thighs when the customizable shapewear 10 is worn, such as generally between the pelvic region and the knees of the wearer. Accordingly, such customizable shapewear 10 may be customized as shorts, briefs, boy-shorts, and the like, or with only one leg region 24 extending above one knee and with the other leg region 24 extending below the other knee, or with the two leg regions 24 at different lengths above the knee, such as if a wearer 12 will be wearing an asymmetrical skirt or dress.

In some examples in which the body 14 comprises leg regions 24, the plurality of leg bands 30 comprises one or more leg bands 30 that are positioned within knee regions 34 of the leg regions 24. Knee regions 34 are regions of the leg regions 24 that correspond to and engage a wearer's knees or are in close proximity to a wearer's knees when the customizable shapewear 10 is worn, such as generally between the wearer's thighs and calves. Accordingly, such customizable shapewear 10 may be customized as long shorts, as knickers, or with different lengths of leg regions, such as to correspond to an asymmetrical lower body garment.

In some examples in which the body 14 comprises leg regions 24, the plurality of leg bands 30 comprises one or more leg bands 30 that are positioned within calf regions 36 of the leg regions 24. Calf regions 36 are regions of the leg regions 24 that correspond to and engage a wearer's calves or are in close proximity to a wearer's calves when the customizable shapewear 10 is worn, such as generally between the wearer's knees and ankles. Accordingly, such customizable shapewear 10 may be customized as knickers or with different lengths of leg regions, such as to correspond to an asymmetrical lower body garment.

In some examples in which the body 14 comprises leg regions 24, the plurality of leg bands 30 comprises one or more leg bands 30 positioned within ankle regions 38 of the leg regions 24. Ankle regions 38 are regions of the leg regions 24 that correspond to and engage a wearer's ankles or are in close proximity to a wearer's ankles when the customizable shapewear 10 is worn. Accordingly, the length of the leg regions 24 of such customizable shapewear 10 may be customized, for example, depending on the length of an outer garment to be worn with the customizable shapewear 10.

With continued reference to FIG. 1 and as noted above, in some examples of customizable shapewear 10, the body 14 comprises a torso region 26, that is, a region of the body 14 that is configured to engage and optionally shape or contour the torso of a wearer 12, optionally including the wearer's abdomen, chest, and/or breasts.

In some examples in which the body 14 comprises a torso region 26, the plurality of distinct applications 20 comprises a front expanse 58 and/or a back expanse 60, as schematically represented in FIG. 1. By an "expanse," it is meant that a respective distinct application 20 extends across a significant portion, such as at least 20%, at least 30%, or at least 50% of the respective region. Such expanses may have any suitable shape depending on the configuration of the customizable shapewear 10 and/or on the desired and/or possible customizations of the torso region 26 of the customizable shapewear 10. As an example, a customizable shapewear 10 with a back expanse 60 may be customized by cutting a hole in the back expanse 60 to correspond with an uncovered portion of a backless dress or blouse. Similarly, a customizable shapewear 10 with a front expanse 58 may be customized by cutting a hole in the front expanse to correspond with an uncovered front or chest portion of a dress or blouse.

With continued reference to FIG. 1 and as noted above, in some examples of customizable shapewear 10, the body 14 comprises arm regions 28, that is, regions of the body 14 that are configured to engage and optionally shape or contour the arms of a wearer 12. In some examples in which the body 14 comprises arm regions 28, the plurality of distinct applications 20 comprises a plurality of arm bands 40 that are spaced-apart along the arm regions 28. When present, each of the plurality of arm bands 40 substantially encircles a respective one of the arm regions 28. In some examples, each of the plurality of arm bands 40 is substantially uniform in width. Accordingly, such arm bands 40 facilitate a user's cutting along a desired path. Non-exclusive examples of suitable widths of leg bands 30 include widths in the range of 0.5-2 cm; however, widths narrower and wider than this range also may be provided.

As schematically represented in FIG. 1, each arm region 28 may be described as having a longitudinal arm axis 46, and in some examples, although not required, one or more, and optionally each, of the plurality of arm bands 40 may be substantially perpendicular to a respective longitudinal arm axis 46. By "substantially perpendicular to a respective longitudinal arm axis 46," it is meant that a respective arm band 40 is within 15° of perpendicular to the respective longitudinal arm axis 46. Accordingly, the arm bands 40 permit a user to generally cut along a straight line that results in a cut line that is perpendicular to the wearer's arms when the customized shapewear 10' is worn.

In some examples, as indicated by the example arm band 40' in FIG. 1, one or more of the plurality of arm bands 40 may be skewed relative to a respective longitudinal arm axis 46. Accordingly, such examples may be used when an outerwear garment has an asymmetrical sleeve or a slit, for example.

With continued reference to FIG. 1, in some examples in which the body 14 comprises arm regions 28, the plurality of arm bands 40 comprises one or more arm bands 40 that are positioned within shoulder regions 48 of the arm regions 28. Shoulder regions 48 are regions of the arm regions 28 that correspond to and engage a wearer's shoulders or shoulder regions when the customizable shapewear 10 is worn, such as generally where the wearer's arms interface with the wearer's torso. Accordingly, such customizable shapewear 10 may be customized as sleeveless, or with one sleeveless arm and one sleeved arm, such as if a wearer 12 will be wearing an asymmetrical top or dress with only one sleeve.

In some examples in which the body 14 comprises arm regions 28, the plurality of arm bands 40 comprises one or more arm bands 40 that are positioned within upper arm regions 52 of the arm regions 28. Upper arm regions 52 are regions of the arm regions 28 that correspond to and engage a wearer's upper arms, that is, the regions between the elbows and the shoulders, when the customizable shapewear 10 is worn. Accordingly, such customizable shapewear 10 may be customized as short sleeves, or with one long sleeve and one short sleeve, or with one short sleeve and one sleeveless, and so forth.

In some examples in which the body 14 comprises arm regions 28, the plurality of arm bands 40 comprises one or more arm bands 40 that are positioned within elbow regions 54 of the arm regions 26. Elbow regions 54 are regions of the arm regions 28 that correspond to and engage a wearer's elbows or are in close proximity to a wearer's elbows when the customizable shapewear 10 is worn, such as generally between the wearer's upper arms and forearms. Accordingly, such customizable shapewear 10 may be customized with half-sleeves, or with one long sleeve and one half sleeve, or with one short sleeve or sleeveless and one half sleeve, and so forth.

In some examples in which the body 14 comprises arm regions 28, the plurality of arm bands 40 comprises one or more arm bands 40 that are positioned within forearm regions 56 of the arm regions 56. Forearm regions 56 are regions of the arm regions 28 that correspond to and engage a wearer's forearms when the customizable shapewear 10 is worn, such as generally between the wearer's wrists and elbows. Accordingly, such customizable shapewear 10 may be customized with three-quarter sleeves, or with one long sleeve and one three-quarter sleeve, or with one short sleeve or sleeveless and one three-quarter sleeve, and so forth.

With continued reference to FIG. 1, some customizable shapewear 10 further comprise a fluid retention gusset 72 that is coupled to the body 14 within a crotch region 74 of the body 14, for example, to absorb and/or retain menstrual fluids and/or urine produced by the wearer. Examples of fluid retentions gussets and methods and structures for coupling fluid retention gussets to the body of a garment are disclosed in U.S. Pat. Nos. 10,441,479, 11,497,263, and 11,701,267, and U.S. patent application Ser. Nos. 17/877,754 and 18/327,716, the complete disclosures of which are incorporated herein by reference.

As schematically illustrated in FIG. 1, some customizable shapewear 10 further comprise (or are accompanied by or provided with) instructions 70 that instruct the wearer 12 on customization of the customizable shapewear 10. Specifically, the instructions 70 instruct the wearer 12 regarding cutting along one or more of the plurality of distinct applications 20 to remove portions of the body 14 and thereby to customize the customizable shapewear 10, resulting in customized shapewear 10'. Such instructions 70 may comprise one or more of packaging 75, an insert 76 provided with the packaging 75, a webpage 78, and/or a mobile application 80. The instructions 70 may include such information as (i) recommended type, size, and/or sharpness of the tool recommended for cutting along a distinct application 20, such as scissors, shears, and the like; (ii) specific techniques for cutting along one or more of the distinct applications 20; (iii) example configurations of customized shapewear 10', such as illustrations of asymmetrical customizations; (iv) instructions specific to customizable shapewear 10 that include a front expanse 58 and/or a back expanse 60, such as related to measuring, marking, and cutting a front expanse 58 and/or back expanse 60 based on the particular outer garment to be worn with the customizable shapewear 10; (v) and so forth.

Turning now to FIGS. 2-7, illustrative non-exclusive examples of customizable shapewear 10 in the form of customizable shapewear 300, 400, and 500 are illustrated. Where appropriate, the reference numerals from the schematic illustration of FIG. 1 are used to designate corresponding parts of customizable shapewear 300, 400, and 500; however, the examples of FIGS. 2-7 are non-exclusive and do not limit customizable shapewear 10 to the illustrated embodiments of customizable shapewear 300, 400, and 500. That is, customizable shapewear 10 are not limited to the specific embodiments of the illustrated customizable shapewear 300, 400, and 500, and customizable shapewear 10 may incorporate any number of the various aspects, configurations, characteristics, properties, etc. of customizable shapewear 10 that are illustrated in and discussed with reference to the schematic representation of FIG. 1 and/or the embodiments of FIGS. 2-7, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to customizable shapewear 300, 400, and 500; however, it is within the scope of the present disclosure that the previously discussed features, variants, etc. may be utilized with customizable shapewear 300, 400, and 500.

Figure 2:
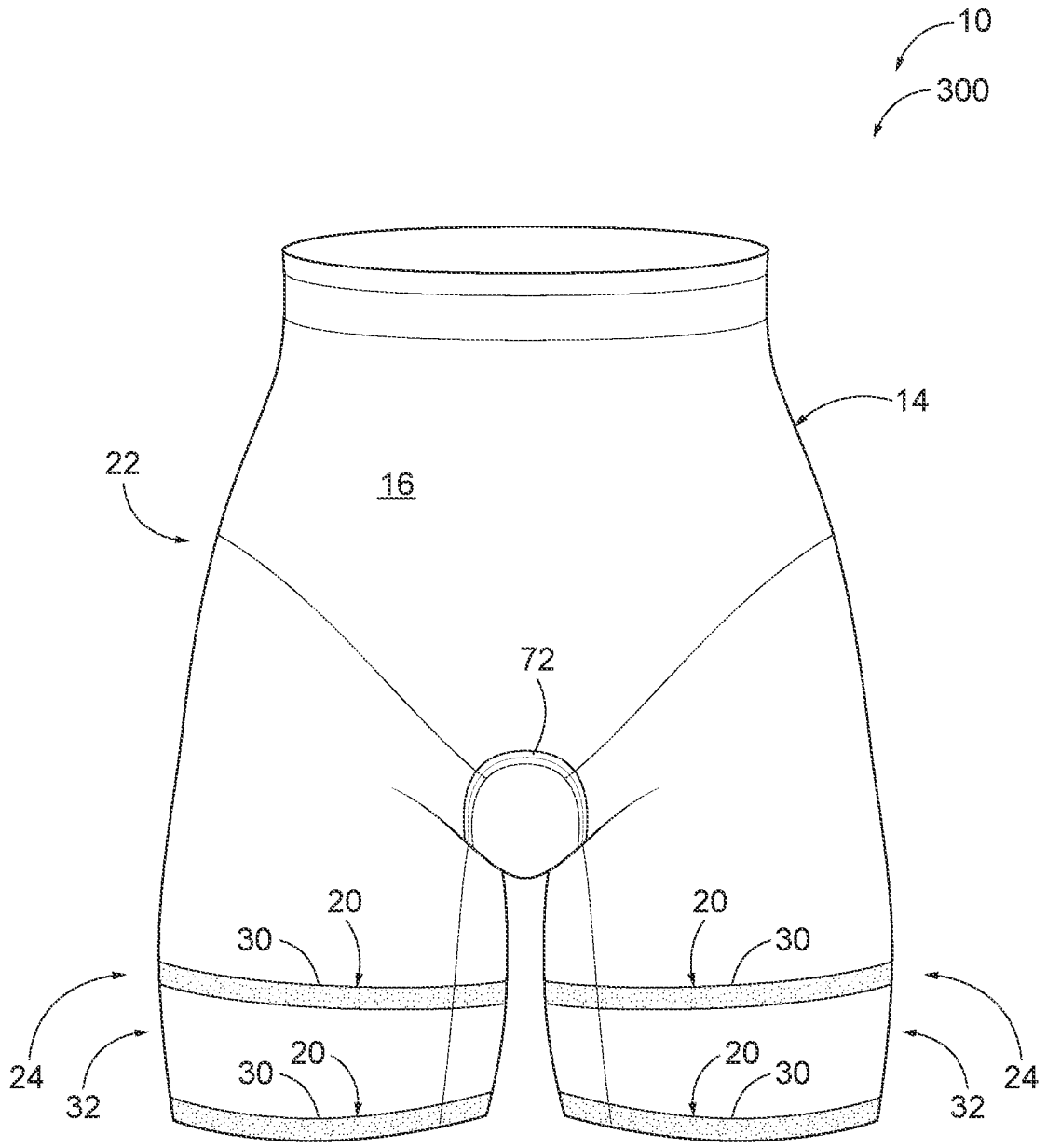
FIG. 2 is a front view of an example customizable shapewear turned inside-out.
Figure 3:
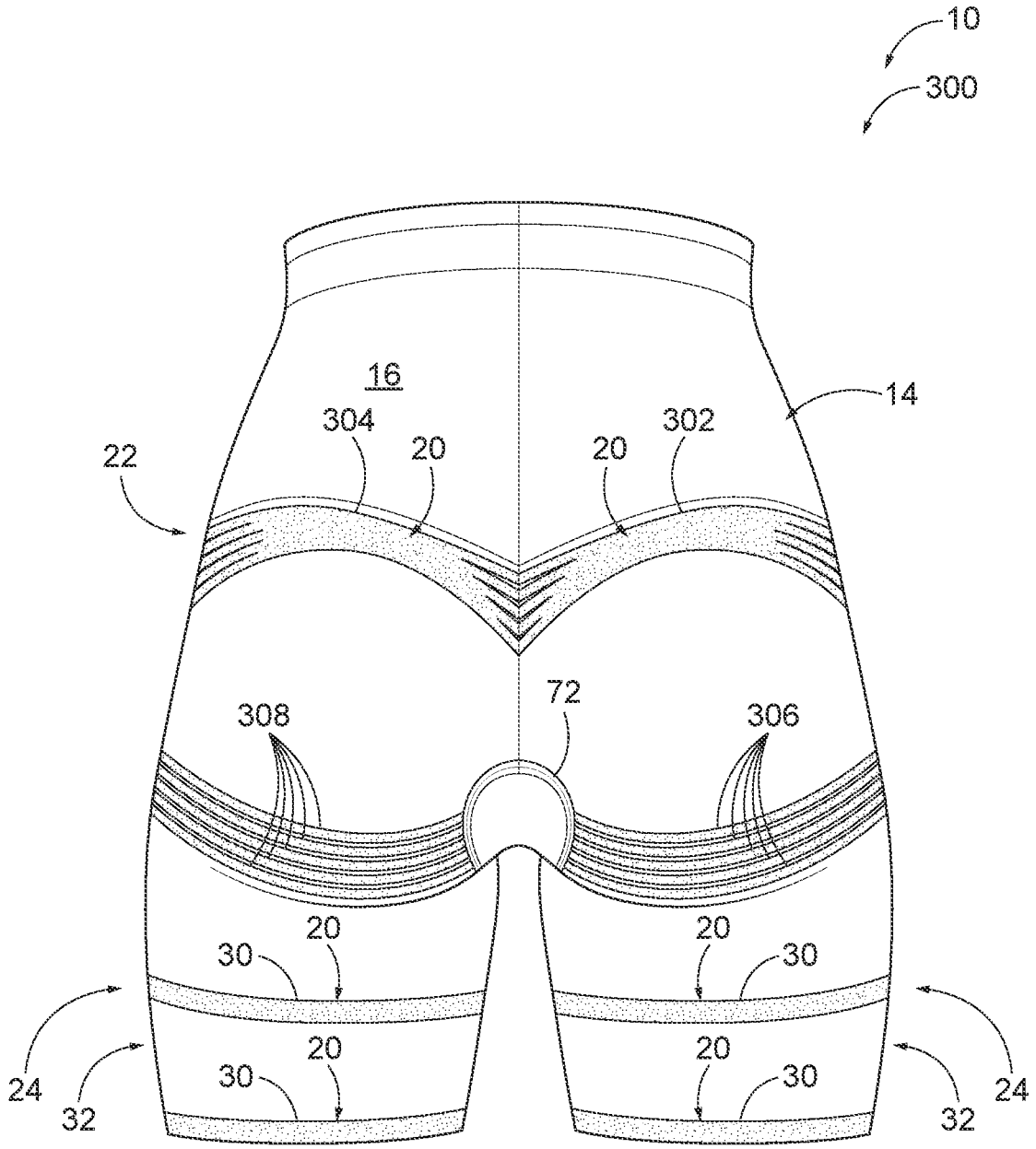
FIG. 3 is a rear view of the example customizable shapewear of FIG. 2 turned inside-out.

With reference first to FIGS. 2 and 3, FIG. 2 is a front view of customizable shapewear 300 turned inside-out, while FIG. 3 is a rear view of customizable shapewear 300 turned inside-out. Customizable shapewear 300 is an example of customizable shapewear 10 comprising a fluid retention gusset 72, whose body 14 comprises leg regions 24 extending from a pelvic region 22 and having thigh regions 32, and which may be described as shorts. Customizable shapewear 300 comprises a plurality of distinct applications 20 including two leg bands 30 within the thigh region 32 of each leg region 24. The leg bands 30 of customizable shapewear 300 are uniform in width and substantially encircle the thigh regions 32. Accordingly, customizable shapewear 300 may be customized by cutting along one or more of the leg bands 30 to customize a length of one or both of the leg regions 24. As illustrated in FIG. 3, customizable shapewear 300 also comprises distinct applications 20 that are configured to shape a wearer's buttocks. In particular, the distinct applications 20 of customizable shapewear 300 comprise a left-side, upper-buttock, downwardly curved application 302, a right-side, upper-buttock, downwardly curved application 304, a series of left-side, lower-buttock, upwardly curved applications 306, and a series of right-side, lower-buttock, upwardly curved applications 308. Accordingly, customizable shapewear 300 may be described as buttock shaping shapewear.

Figure 4:
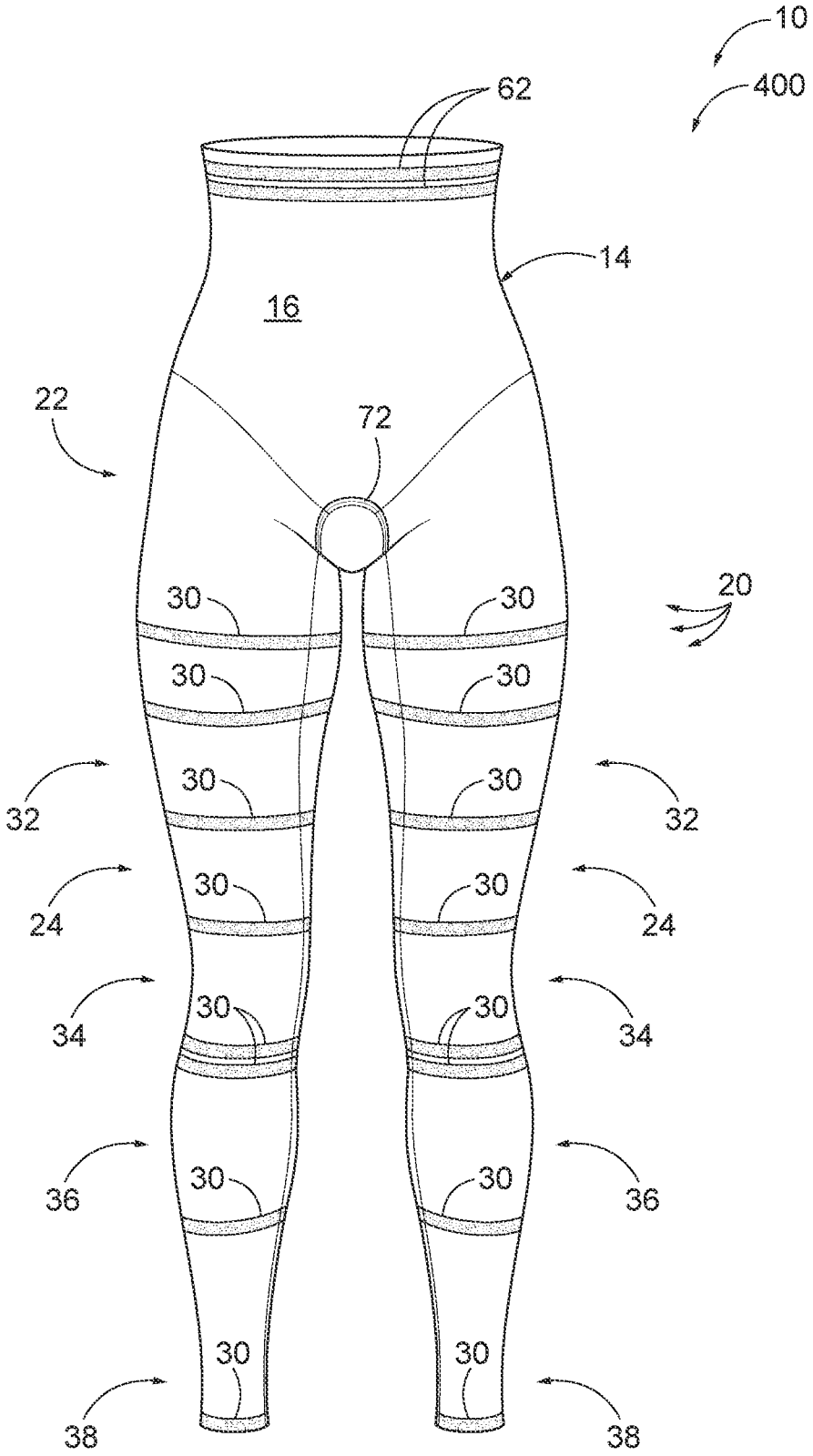
FIG. 4 is a front view of another example customizable shapewear turned inside-out.
Figure 5:
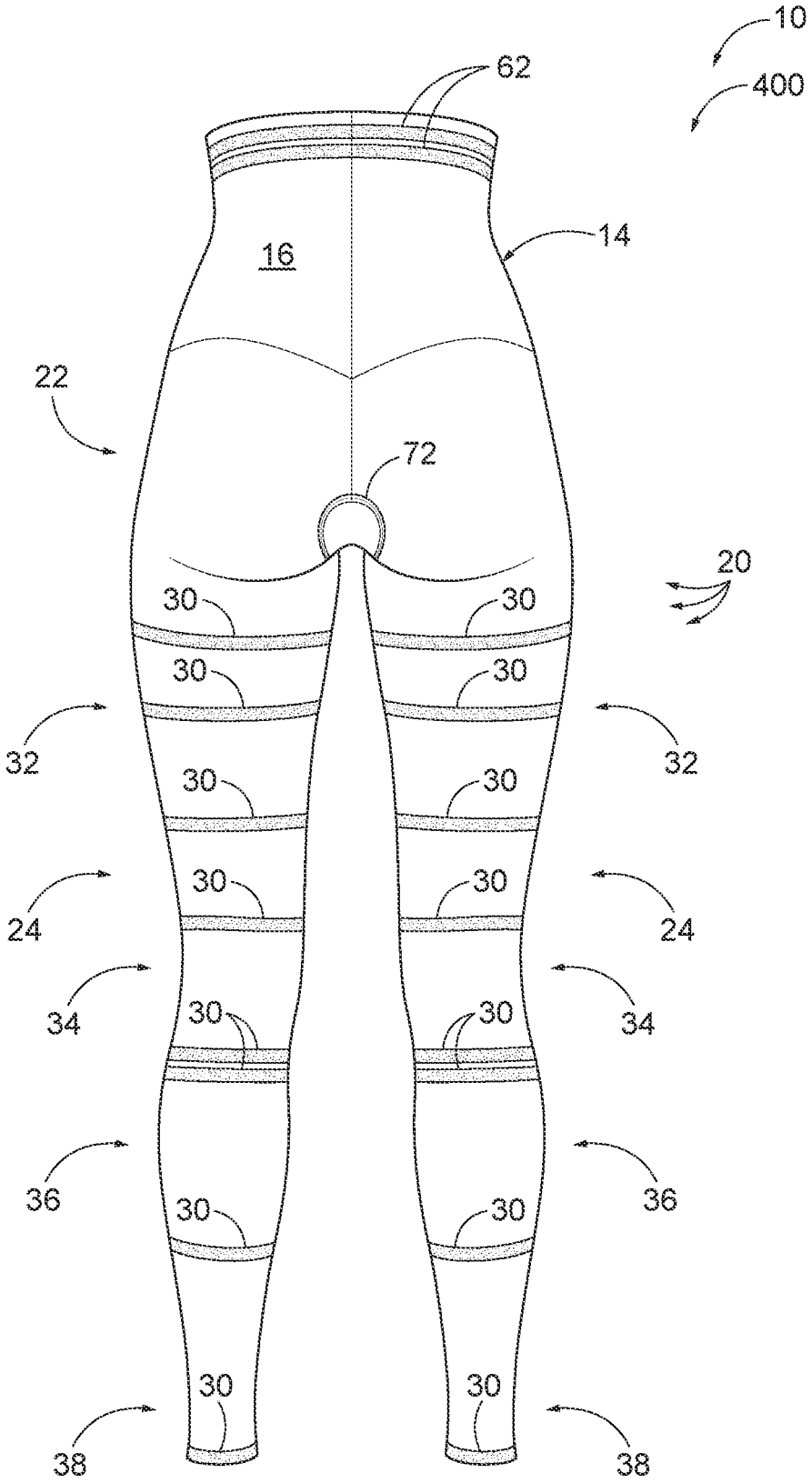
FIG. 5 is a rear view of the example customizable shapewear of FIG. 4 turned inside-out.

With reference next to FIGS. 4 and 5, customizable shapewear 400 is an example of customizable shapewear 10 comprising a fluid retention gusset 72, whose body 14 comprises leg regions 24 extending from a pelvic region 22 and having thigh regions 32, knee regions 34, calf regions 36, and ankle regions 38, and which may be described as pants or leggings. Customizable shapewear 400 comprises a plurality of distinct applications 20 including leg bands 30 within each of the thigh regions 32, knee regions 34, calf regions 36, and ankle regions 38. The leg bands 30 of customizable shapewear 300 are uniform in width and substantially encircle the leg regions 24. The plurality of distinct applications 20 of customizable shapewear 400 also includes waist bands 62 that are uniform in width and substantially encircle the body 14. Accordingly, customizable shapewear 400 may be customized by cutting along one of the waist bands 62 to customize a height of the waist, and/or along one or more of the leg bands 30 to customize a length of one or both of the leg regions 24.

Figure 6:
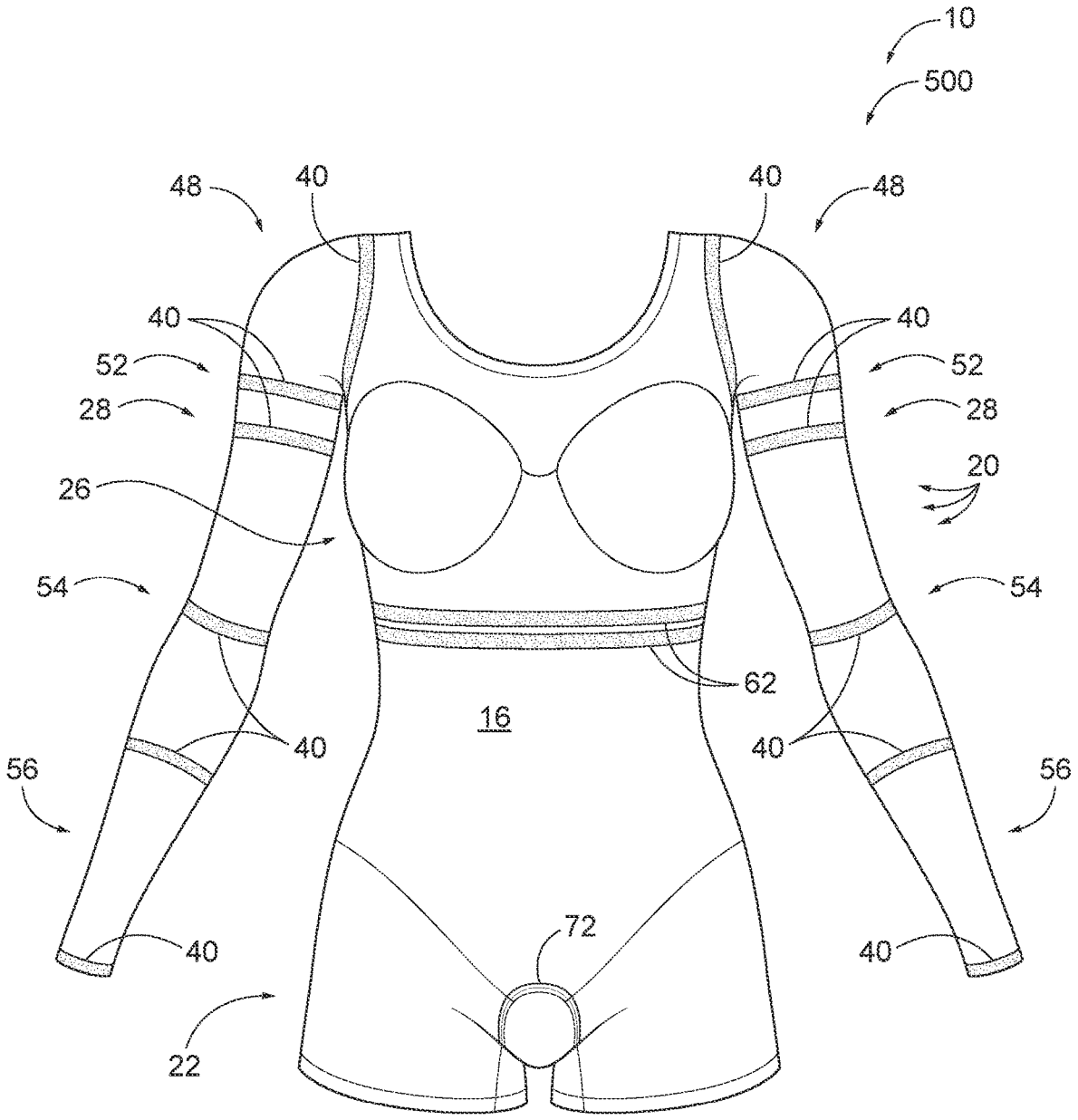
FIG. 6 is a front view of another example customizable shapewear turned inside-out.
Figure 7:
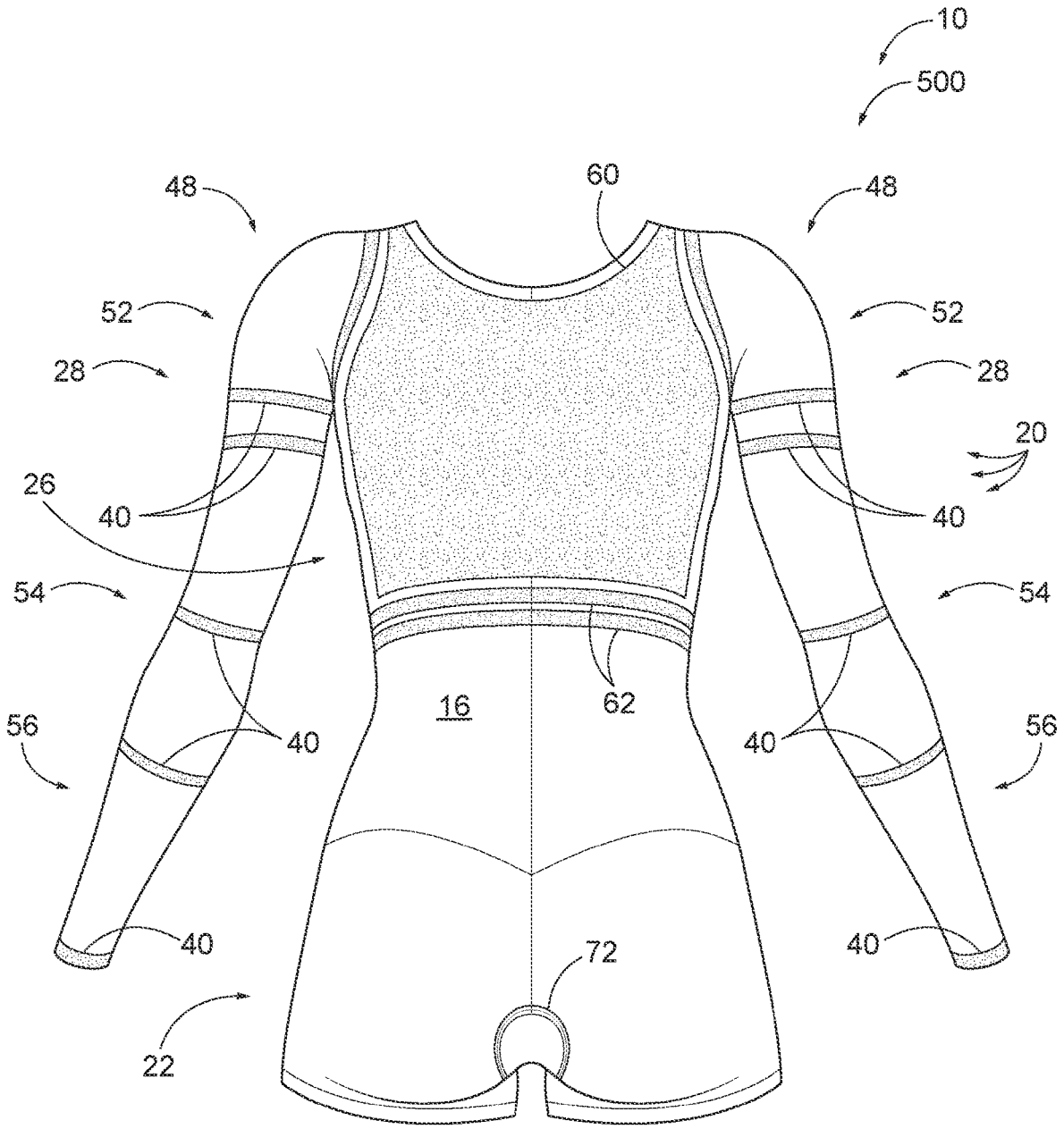
FIG. 7 is a rear view of the example customizable shapewear of FIG. 4 turned inside-out.

With reference next to FIGS. 6 and 7, customizable shapewear 500 is an example of customizable shapewear 10 comprising a fluid retention gusset 72, whose body comprises a torso region 26 extending upward from a pelvic region 22 and arm regions 28 extending from the torso region 26 and having shoulder regions 48, upper arm regions 52, elbow regions 54, and forearm regions 56, and which may be described as a bodysuit. Customizable shapewear 500 comprises a plurality of distinct applications 20 including arm bands 40 within each of the shoulder regions 48, the upper arm regions 52, the elbow regions 54, and the forearm regions 56. The arm bands 40 of customizable shapewear 500 are uniform in width and substantially encircle the arm regions 28. Accordingly, customizable shapewear 500 may be customized by cutting along one or more of the arm bands 28 to customize a length of one or both of the arm regions 28. As illustrated in FIG. 7, the plurality of distinct applications 20 of customizable shapewear 500 also includes a back expanse 60, so that customizable shapewear 500 may be customized for use with a backless garment such as a dress or top. The plurality of distinct applications 20 of customizable shapewear 500 also includes waist bands 62 that are uniform in width and substantially encircle the body 14. Accordingly, customizable shapewear 500 may be customized by cutting along one of the waist bands 62 to customize the length of the torso region 26.

Figure 8:
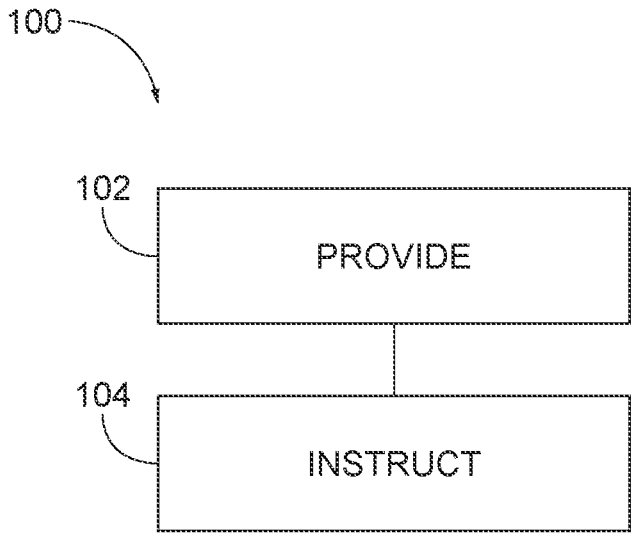
FIG. 8 is a flowchart schematically representing example methods according to the present disclosure.
Figure 9:
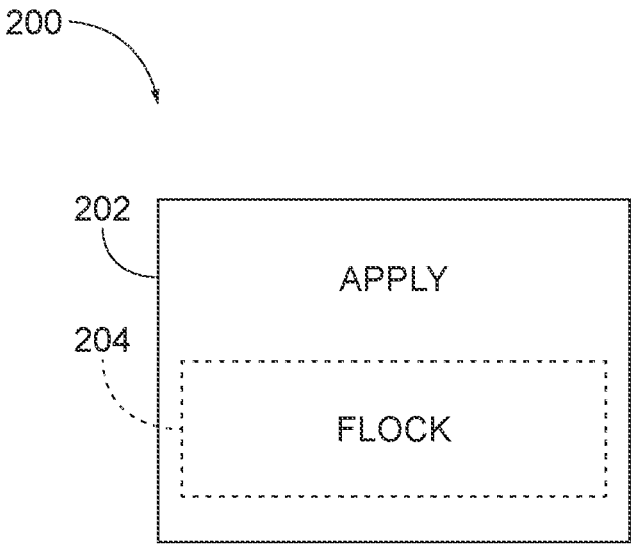
FIG. 9 is a flowchart schematically representing additional example methods according to the present disclosure.

Turning finally to FIGS. 8 and 9, FIGS. 8 and 9 schematically provide flowcharts that represent illustrative, non-exclusive examples of methods according to the present disclosure. In FIGS. 8 and 9, some steps are illustrated in dashed boxes indicating that such steps may be optional or may correspond to an optional version of a method according to the present disclosure. That said, not all methods according to the present disclosure are required to include the steps illustrated in solid boxes. The methods and steps illustrated in FIGS. 8 and 9 are not limiting and other methods and steps are within the scope of the present disclosure, including methods having greater than or fewer than the number of steps illustrated, as understood from the discussions herein.

As schematically represented in FIG. 8, methods 100 comprise at least providing 102 customizable shapewear 10 according to the present disclosure, and instructing 104 the wearer 12 to cut along one or more of the plurality of distinct applications 20 of the customizable shapewear 10. The providing 102 may comprise one or more of selling, offering for sale, shipping, and/or delivering the customizable shapewear 10 to a customer. The instructing 104 may be provided via printed instructions 70 as discussed herein, including electronic or online delivery, such as via a website.

As schematically represented in FIG. 9, methods 200 of manufacturing customizable shapewear 10 according to the present disclosure comprise at least applying 202 the plurality of distinct applications 20 to the body 14 of the customizable shapewear 10. In some examples, the applying 202 comprises flocking 204 the plurality of distinct applications 20 to the body 14; however, other methods of applying 202 also may be used.

Illustrative, non-exclusive examples of inventive subject matter according to the present disclosure are described in the following enumerated paragraphs:

A. Customizable shapewear (10) to be worn by a wearer (12), comprising:

a body (14) constructed of a fabric having an interior side (16) that faces the wearer (12) when the customizable shapewear (10) is worn by the wearer (12), and an exterior side (18) that faces away from the wearer (12) when the customizable shapewear (10) is worn by the wearer (12); and a plurality of distinct applications (20) on the interior side (16) of the body (14) and/or on the exterior side (18).

A1. The customizable shapewear (10) of paragraph A, wherein the plurality of distinct applications (20) is on at least the interior side (16) of the body (14).

A2. The customizable shapewear (10) of any of paragraphs A-A1, wherein the plurality of distinct applications (20) is only on the interior side (16) of the body (14).

A3. The customizable shapewear (10) of any of paragraphs A-A1, wherein the plurality of distinct applications (20) is on at least the exterior side (18) of the body (14).

A4. The customizable shapewear (10) of paragraph A, wherein the plurality of distinct applications (20) is only on the exterior side (18) of the body (14).

A5. The customizable shapewear (10) of any of paragraphs A-A4, wherein, when the body (14) is selectively cut along a selected distinct application (20) of the plurality of distinct applications (20), the selected distinct application (20) is configured to restrict rolling of the body (14) adjacent to the selected distinct application (20) when the customizable shapewear (10) is worn by the wearer (12).

A6. The customizable shapewear (10) of any of paragraphs A-A5, wherein, when the body (14) is selectively cut along a/the selected distinct application (20) of the plurality of distinct applications (20), the selected distinct application (20) is configured to restrict sliding of the body (14) adjacent to the selected distinct application (20) relative to the wearer (12) when the customizable shapewear (10) is worn by the wearer (12).

A7. The customizable shapewear (10) of any of paragraphs A-A6, wherein, when the body (14) is selectively cut along a/the selected distinct application (20) of the plurality of distinct applications (20), the selected distinct application (20) is configured to restrict fraying of the body (14) adjacent to the selected distinct application (20).

A8. The customizable shapewear (10) of any of paragraphs A-A7, wherein the fabric has a first texture, and wherein the plurality of distinct applications (20) have a second texture that differs from the first texture.

A8.1. The customizable shapewear (10) of paragraph A8, wherein the first texture has a first coefficient of friction, and wherein the second texture has a second coefficient of friction that is greater than the first coefficient of friction.

A8.2. The customizable shapewear (10) of any of paragraphs A8-A8.1, wherein the second texture is configured to provide a no-slip surface against the wearer (12) when the customizable shapewear (10) is worn by the wearer (12).

A9. The customizable shapewear (10) of any of paragraphs A-A8.2, wherein the fabric of the body (14) has a first elastic modulus, and wherein the plurality of distinct applications (20) has a second elastic modulus that is greater than the first elastic modulus.

A10. The customizable shapewear (10) of any of paragraphs A-A9, wherein the fabric of the body (14) has a/the first elastic modulus, and wherein a combination of the fabric and the plurality of distinct applications (20) has a/the second elastic modulus that is greater than the first elastic modulus.

A11. The customizable shapewear (10) of any of paragraphs A-A10, wherein the body (14) is constructed of one or more of spandex (elastane), nylon, cotton, bamboo, and/or modal.

A12. The customizable shapewear (10) of any of paragraphs A-A11, wherein the plurality of distinct applications (20) is constructed of one or more of acrylic, silicone, nylon, polyester, spandex, cotton, bamboo, modal, bonding fabric, and/or seamless material produced on a double knit electronic circular knitting machine.

A13. The customizable shapewear (10) of any of paragraphs A-A12, wherein the plurality of distinct applications (20) is adhered to the body (14).

A14. The customizable shapewear (10) of any of paragraphs A-A13, wherein the plurality of distinct applications (20) is stitched to the body (14).

A15. The customizable shapewear (10) of any of paragraphs A-A14, wherein the plurality of distinct applications (20) comprises fine particles or fine fibers.

A16. The customizable shapewear (10) of any of paragraphs A-A15, wherein the plurality of distinct applications (20) comprises flocking applied to the body (14).

A17. The customizable shapewear (10) of any of paragraphs A-A16, wherein the body (14) comprises one or more of:

a pelvic region (22);

leg regions (24) extending inferior from the pelvic region (22);

a torso region (26), optionally extending superior from the pelvic region (22); and arm regions (28) extending from the torso region (26).

A17.1. The customizable shapewear (10) of paragraph A17, wherein the body (14) comprises the pelvic region (22), wherein the plurality of distinct applications (20) comprises one or more waist bands (62) positioned superior to the pelvic region (22).

A17.1.1. The customizable shapewear (10) of paragraph A17.1, wherein the one or more waist bands (62) comprise a plurality of waist bands (62).

A17.1.2. The customizable shapewear (10) of any of paragraphs A17.1-A17.1.1, wherein each of the one or more waist bands (62) substantially encircles the body (14).

A17.1.3. The customizable shapewear (10) of any of paragraphs A17.1-A17.1.2, wherein each of the one or more waist bands (62) is substantially uniform in width.

A17.1.4. The customizable shapewear (10) of any of paragraphs A17.1-A17.1.3, wherein the body (14) has a longitudinal body axis (64), and wherein each of the one or more waist bands (62) is substantially perpendicular to the longitudinal body axis (64).

A17.2. The customizable shapewear (10) of any of paragraphs A17-A17.1.4, wherein the body (14) comprises the pelvic region (22) and the leg regions (24), wherein the plurality of distinct applications (20) comprises one or more hip bands (50) at interfaces between the leg regions (24) and the pelvic region (22).

A17.3. The customizable shapewear (10) of any of paragraphs A17-A17.2, wherein the body (14) comprises the pelvic region (22) and the leg regions (24), wherein the plurality of distinct applications (20) comprises a plurality of leg bands (30) spaced-apart along the leg regions (24), and wherein each of the plurality of leg bands (30) substantially encircles a respective one of the leg regions (24).

A17.3.1. The customizable shapewear (10) of paragraph A17.3, wherein each of the plurality of leg bands (30) is substantially uniform in width.

A17.3.2. The customizable shapewear (10) of any of paragraphs A17.3-A17.3.1, wherein each leg region (24) of the leg regions (24) has a longitudinal leg axis (44), and wherein one or more, and optionally each, of the plurality of leg bands (30) is substantially perpendicular to a respective longitudinal leg axis (44).

A17.3.3. The customizable shapewear (10) of any of paragraphs A17.3-A17.3.2, wherein each leg region (24) of the leg regions (24) has a/the longitudinal leg axis (44), and wherein one or more of the plurality of leg bands (30) is skew relative to a/the respective longitudinal leg axis (44).

A17.3.4. The customizable shapewear (10) of any of paragraphs A17.3-A17.3.3, wherein the plurality of leg bands (30) comprises one or more leg bands (30) positioned within thigh regions (32) of the leg regions (24).

A17.3.5. The customizable shapewear (10) of any of paragraphs A17.3-A17.3.4, wherein the plurality of leg bands (30) comprises one or more leg bands (30) positioned within knee regions (34) of the leg regions (24).

A17.3.6. The customizable shapewear (10) of any of paragraphs A17.3-A17.3.5, wherein the plurality of leg bands (30) comprises one or more leg bands (30) positioned within calf regions (36) of the leg regions (24).

A17.3.7. The customizable shapewear (10) of any of paragraphs A17.3-A17.3.6, wherein the plurality of leg bands (30) comprises one or more leg bands (30) positioned within ankle regions (38) of the leg regions (24).

A17.4. The customizable shapewear (10) of any of paragraphs A17-A17.3.7, wherein the body (14) comprises the torso region (26).

A17.4.1. The customizable shapewear (10) of paragraph A17.4, wherein the plurality of distinct applications (20) comprises a front expanse (58).

A17.4.2. The customizable shapewear (10) of paragraph A17.4, wherein the plurality of distinct applications (20) comprises a back expanse (60).

A17.4.3. The customizable shapewear (10) of any of paragraphs A17.4-A17.4.2, wherein the body (14) comprises the arm regions (28), wherein the plurality of distinct applications (20) comprises a plurality of arm bands (40) spaced-apart along the arm regions (28), and wherein each of the plurality of arm bands (40) substantially encircles a respective one of the arm regions (28).

A17.4.3.1. The customizable shapewear (10) of paragraph A17.4.3, wherein each of the plurality of arm bands (40) is substantially uniform in width.

A17.4.3.2. The customizable shapewear (10) of any of paragraphs A17.4.3-A17.4.3.1, wherein each arm region (28) of the arm regions (28) has a longitudinal arm axis (46), and wherein one or more, and optionally each, of the plurality of arm bands (40) is substantially perpendicular to a respective longitudinal arm axis (46).

A17.4.3.3. The customizable shapewear (10) of any of paragraphs A17.4.3-A17.4.3.2, wherein each arm region (28) of the arm regions (28) has a/the longitudinal arm axis (46), and wherein one or more of the plurality of arm bands (40) is skew relative to a/the respective longitudinal arm axis (46).

A17.4.3.4. The customizable shapewear (10) of any of paragraphs A17.4.3-A17.4.3.3, wherein the plurality of arm bands (40) comprises one or more arm bands (40) positioned within shoulder regions (48) of the arm regions (28).

A17.4.3.5. The customizable shapewear (10) of any of paragraphs A17.4.3-A17.4.3.4, wherein the plurality of arm bands (40) comprises one or more arm bands (40) positioned within upper arm regions (52) of the arm regions (28).

A17.4.3.6. The customizable shapewear (10) of any of paragraphs A17.4.3-A17.4.3.5, wherein the plurality of arm bands (40) comprises one or more arm bands (40) positioned within elbow regions (54) of the arm regions (26).

A17.4.3.7. The customizable shapewear (10) of any of paragraphs A17.4.3-A17.4.3.6, wherein the plurality of arm bands (40) comprises one or more arm bands (40) positioned within forearm regions (56) of the arm regions (56).

A18. The customizable shapewear (10) of any of paragraphs A-A17.4.3.7, further comprising printed instructions (70) instructing the wearer (12) to cut along one or more of the plurality of distinct applications (20).

A18.1. The customizable shapewear of paragraph A18, wherein the printed instructions (70) comprise one or more of packaging (75), an insert (76) provided with the packaging (75), a webpage (78), and/or a mobile application (80).

A19. The customizable shapewear (10) of any of paragraphs A-A18.1, further comprising a fluid retention gusset (72) coupled to the body (14) within a crotch region (74) of the body (14).

B. A method (100), comprising:

providing (102) the customizable shapewear (10) of any of paragraphs A-A19; and instructing (104) the wearer (12) to cut along one or more of the plurality of distinct applications (20).

C. A method (200) of manufacturing the customizable shapewear (10) of any of paragraphs A-A19, comprising:

applying (202) the plurality of distinct applications (20) to the body (14).

C1. The method (200) of paragraph C, wherein the applying (202) comprises flocking (204) the plurality of distinct applications (20) to the body (14).

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. Customizable shapewear to be worn by a wearer, comprising:

a body constructed of a fabric, wherein the body has an interior side that faces the wearer when the customizable shapewear is worn by the wearer, and an exterior side that faces away from the wearer when the customizable shapewear is worn by the wearer; and a plurality of distinct applications on the interior side of the body;

wherein the body comprises a pelvic region and (i) legs extending inferior from the pelvic region and/or (ii) a torso region extending superior from the pelvic region;

wherein, when the body is selectively cut along a selected distinct application of the plurality of distinct applications, the selected distinct application is configured to restrict rolling of the body adjacent to the selected distinct application when the customizable shapewear is worn by the wearer;

wherein one or more of:

the fabric has a first texture and the plurality of distinct applications has a second texture that differs from the first texture;

when the body is selectively cut along a selected distinct application of the plurality of distinct applications, the selected distinct application is configured to restrict sliding of the body adjacent to the selected distinct application relative to the wearer when the customizable shapewear is worn by the wearer; and/or when the body is selectively cut along a selected distinct application of the plurality of distinct applications, the selected distinct application is configured to restrict fraying of the body adjacent to the selected distinct application; and wherein one or more of:

the body extends superior from the pelvic region, wherein the plurality of distinct applications comprises two or more waist bands positioned superior to the pelvic region, wherein the two or more waist bands are parallel to each other, and wherein each of the two or more waist bands individually encircles at least 95% the body;

the body comprises the legs, wherein the plurality of distinct applications comprises one or more hip bands at interfaces between the legs and the pelvic region, wherein each of the one or more hip bands individually encircles at least 95% of a respective one of the legs; and/or the body comprises the legs, wherein the plurality of distinct applications comprises a plurality of leg bands spaced-apart along the legs, wherein the leg bands of each leg are parallel to each other, wherein each of the plurality of leg bands individually encircles at least 95% of a respective one of the legs.

2. The customizable shapewear of claim 1, wherein, when the body is selectively cut along the selected distinct application of the plurality of distinct applications, the selected distinct application is configured to restrict sliding of the body adjacent to the selected distinct application relative to the wearer when the customizable shapewear is worn by the wearer.

3. The customizable shapewear of claim 1, wherein, when the body is selectively cut along the selected distinct application of the plurality of distinct applications, the selected distinct application is configured to restrict fraying of the body adjacent to the selected distinct application.

4. The customizable shapewear of claim 1, wherein the fabric has the first texture and the plurality of distinct applications has the second texture that differs from the first texture.

5. The customizable shapewear of claim 4, wherein the first texture has a first coefficient of friction, and wherein the second texture has a second coefficient of friction that is greater than the first coefficient of friction.

6. The customizable shapewear of claim 4, wherein the second texture is configured to provide a no-slip surface against the wearer when the customizable shapewear is worn by the wearer.

7. The customizable shapewear of claim 1, wherein the fabric of the body has a first elastic modulus, and wherein a combination of the fabric and the plurality of distinct applications has a second elastic modulus that is greater than the first elastic modulus.

8. The customizable shapewear of claim 1, wherein the plurality of distinct applications comprises flocking applied to the body.

9. The customizable shapewear of claim 1, wherein the plurality of distinct applications is adhered to the body.

10. The customizable shapewear of claim 1, wherein the body extends superior from the pelvic region, and wherein the plurality of distinct applications comprises the two or more waist bands.

11. The customizable shapewear of claim 1, wherein the body comprises the legs, and wherein the plurality of distinct applications comprises the one or more hip bands.

12. The customizable shapewear of claim 1, wherein the body comprises the legs, and wherein the plurality of distinct applications comprises the plurality of leg bands spaced-apart along the legs.

13. The customizable shapewear of claim 12, wherein each of the plurality of leg bands is substantially uniform in width.

14. The customizable shapewear of claim 12, wherein each leg of the legs has a longitudinal leg axis, and wherein one or more the plurality of leg bands is substantially perpendicular along an entire length of the respective leg band to a respective longitudinal leg axis.

15. The customizable shapewear of claim 1, wherein the body comprises the torso region.

16. The customizable shapewear of claim 15, wherein the plurality of distinct applications comprises:

a front expanse that extends across at least 30% of a front surface area of the torso region; and/or a back expanse that extends across at least 30% of a rear surface are of the torso region.

17. The customizable shapewear of claim 15, wherein the body comprises arms extending from the torso region, wherein the plurality of distinct applications comprises a plurality of arm bands spaced-apart along the arms, wherein the arm bands of each arm are parallel to each other, and wherein each of the plurality of arm bands individually encircles at least 95% of a respective one of the arms.

18. The customizable shapewear of claim 17, wherein each of the plurality of arm bands is substantially uniform in width.

19. The customizable shapewear of claim 17, wherein each arm of the arms has a longitudinal arm axis, and wherein one or more of the plurality of arm bands is substantially perpendicular along an entire length of the responsive arm band to a respective longitudinal arm axis.

20. The customizable shapewear of claim 1, further comprising printed instructions instructing the wearer to cut along one or more of the plurality of distinct applications.

21. The customizable shapewear of paragraph 20, wherein the printed instructions comprise one or more of packaging, an insert provided with the packaging, a webpage, and/or a mobile application.

22. The customizable shapewear of claim 1, further comprising a fluid retention gusset coupled to the body within a crotch region of the body.

23. A method, comprising:

providing the customizable shapewear of claim 1; and instructing the wearer to cut along one or more of the plurality of distinct applications.

24. A method of manufacturing the customizable shapewear of claim 1, comprising:

applying the plurality of distinct applications to the body.

25. The method of claim 24, wherein the applying comprises flocking the plurality of distinct applications to the body.

* * * * *